United States Patent [19]

Immordino

[11] 4,148,413

[45] Apr. 10, 1979

[54] MULTI-CHANNELBOX-DISPENSER UNIT

[75] Inventor: Vincent J. Immordino, Flushing, N.Y.

[73] Assignee: Display Originals, Inc., West Babylon, N.Y.

[21] Appl. No.: 787,006

[22] Filed: Apr. 13, 1977

[51] Int. Cl.[2] ..... A47F 1/08

[52] U.S. Cl. ..... 221/92; 221/305; 211/49 D; 229/17 B; 264/285

[58] Field of Search ..... 221/92, 303, 305, 307- 310, 221/111; 211/49 D; 312/42; 229/17 B; 264/285, 296; 425/385; 220/6, 7

[56] References Cited

U.S. PATENT DOCUMENTS

| | | | |
|---|---|---|---|
| 2,848,751 | 8/1958 | Vernon | 264/285 X |
| 3,000,275 | 9/1961 | Sevison | 425/385 X |
| 3,858,745 | 1/1975 | Cloyd | 220/7 |
| 3,957,174 | 5/1976 | Palamara | 221/309 X |
| 4,005,795 | 2/1977 | Mikkelsen et al. | 220/7 |

*Primary Examiner*—Stanley H. Tollberg
*Assistant Examiner*—Francis J. Bartuska
*Attorney, Agent, or Firm*—Michael Ebert

[57] ABSTRACT

A vertically-mountable dispenser unit for storing and individually dispensing a large number of small boxes. The unit is formed by a frame including a pair of side walls having corresponding-positioned, inwardly-directed ridges thereon that divide the unit into parallel channels for receiving the boxes. Each channel has a discharge opening at the lower end thereof which is terminated by a ledge whereby the boxes are retained in the channels by the ledges and may be laterally withdrawn therefrom. The unit is fabricated of clear thermoplastic material and is created from a flat injection-molded blank that is thermally folded to assume the desired configuration.

3 Claims, 8 Drawing Figures

Fig. 1.
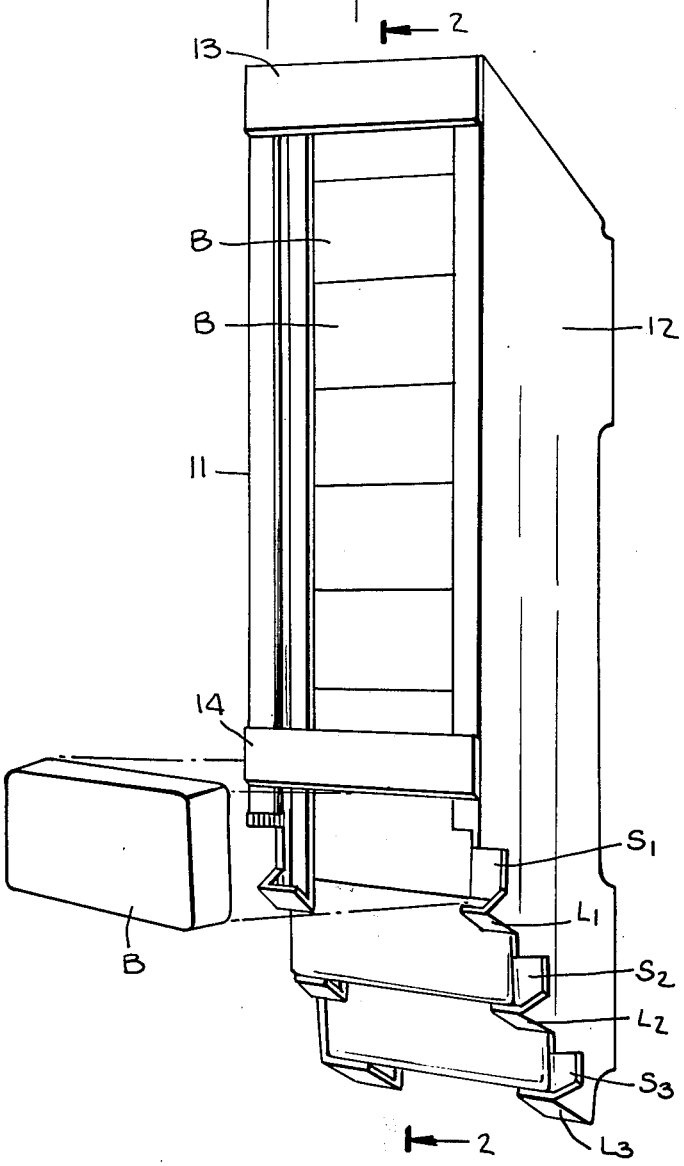
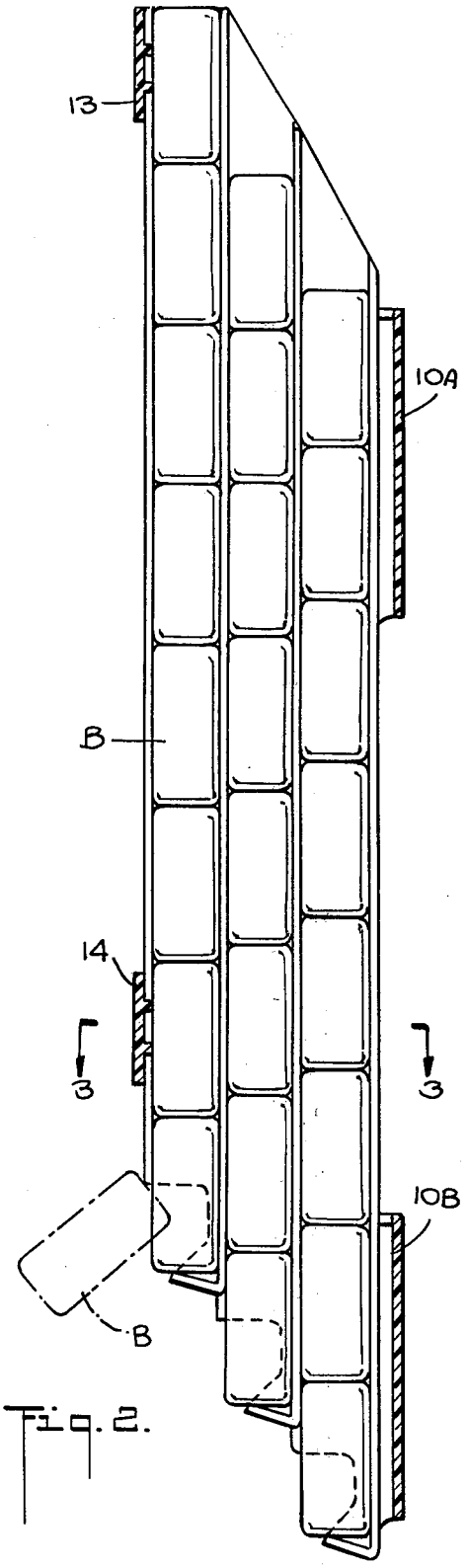
Fig. 2.
Fig. 3.
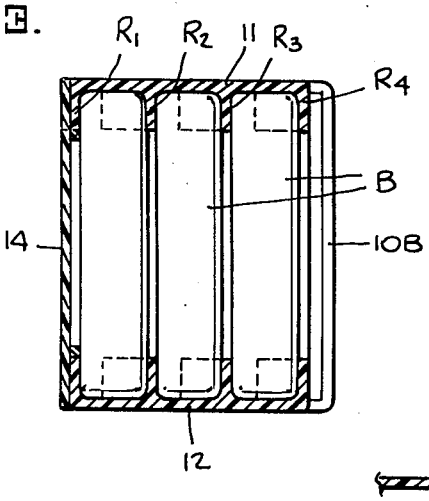
Fig. 5.
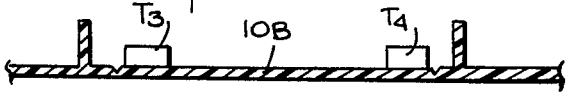

T1
T2
T3
T4
10A
10B
10
11
12
13
14
14'
14'A
14'B
14'B
G
R1
R2
R3
R4
S1
S2
S3
L1
L2
L3
La
Lb
5

MULTI-CHANNELBOX-DISPENSER UNIT

BACKGROUND OF THE INVENTION

This invention relates generally to dispenser units for boxed goods, and in particular to a compact, multi-channel dispenser unit of high capacity, formed of thermoplastic material and created from a flat blank that is thermally folded to assume the desired form.

In the merchandising of candy, drugs and other products contained in small boxes, it is desirable that the product be attractively displayed in order to draw customers. The display on the counter of a single box is not feasible, for then the box is obscured by many other competing products. Moreover, when the product is advertised by a counter display card, but the supply of boxes is at another location, then should a customer seek to make a purchase, the sales person must leave the counter to find the supply and take a box therefrom, thereby complicating the transaction.

In order to provide dispensers which act both to store and display small containers of merchandise, it is known to provide units for this purpose which may be suspended from a wall or placed on the counter to attract customers and to facilitate purchases.

In the prior U.S. Pat. Nos. to Palamara 3,957,174 and Immordino, 3,993,196, there are disclosed box-dispensing units, each constituted by a frame whose side walls are provided with inwardly-projecting ridges that divide the frame interior into channels for accommodating the boxes to be stored, the front and rear edges of the side walls being bridged by upper and lower cross slats.

Box dispensing units of the type disclosed in the Palamara and Immordino patents are used in large quantities, and in order to mass-produce these units at low cost, they are injection-molded. An injection mold consists of two major parts, one stationary and the other movable. The stationary part is secured to the stationary platen of the machine and, in operation, directly contracts the nozzle of the injection cylinder. The movable part is attached to the movable platen of the machine and houses the ejector mechanism.

If the configuration of the plastic part to be molded is such that it is free of undercuts, then the part can be fully developed by the mold cavities and the part can be molded in a one-piece operation so that the part ejected from the mold is finished and ready to use. Otherwise, when there are undercuts, the complete structure can only be made by molding two or more pieces and thereafter assembling the pieces by secondary operation to complete the unit.

In order to avoid undercuts and make possible a one-piece molding operation, the Palamara patent discloses a relatively complex dispenser unit configuration in which the ledges projecting from the side walls of the frame are of progressively increasing width and have slots so formed therein that undercuts are absent. The practical difficulty with the Palamara structure, apart from its complexity, is that it dictates an elaborate and costly mold design.

SUMMARY OF INVENTION

In view of the foregoing, it is the main object of this invention to provide a vertically-mounted dispenser unit for storing and individually dispensing a large number of small boxes, the configuration of the unit being such that it may be mass-produced efficiently and at low cost.

More particularly, it is an object of the invention to provide a unit formed of thermoplastic material that is created from a flat blank that is injection-molded in a one-piece operation involving a simple, inexpensive mold design, which blank is thereafter thermally folded to assume the desired configuration.

While the entire unit is not completed by the one-piece injection-molding operation, the required secondary operations do not add substantially to the production costs, and the resultant unit is much less expensive to produce than an equivalent unit made of two or more pieces, all of which are injection molded.

Briefly stated, these objects are attained by injection molding a flat blank formed of thermoplastic material, the blank being constituted by a back wall section integral with a pair of opposing side wall sections. Each side wall section has a series of longitudinal ridges formed therein at corresponding positions, the outermost ridge running along the outer edge of the side wall section, and the innermost ridge running along the junction of the side wall section and the back section. The lower edges of the side wall sections having a progressively stepped formation and the ridges at these steps are terminated by holding ledges.

The injection-molded blank is then thermally folded to cause the side wall sections to assume parallel positions at right angles to the back section, the ridges then defining parallel channels for receiving the boxes to be dispensed, the side wall steps then defining discharge openings limited by the ledges whereby the ledges serve to maintain the boxes in the channels, which boxes may be laterally withdrawn through the discharge openings. The unit is completed simply by attaching one or more transverse slats across the front edges of the side walls.

OUTLINE OF DRAWINGS

For a better understanding of the invention as well as other objects and further features thereof, reference is made to the following detailed description to be read in conjunction with the accompanying drawings, wherein:

FIG. 1 is a perspective view of a box dispenser unit in accordance with the invention;

FIG. 2 is a longitudinal section of the unit taken in the plane indicated by line 2—2 in FIG. 1;

FIG. 3 is a transverse section of the unit taken in the plane indicated by line 3—3 in FIG. 2;

DESCRIPTION OF INVENTION

The Blank

Figures 4, 5, 6, 7, 8:
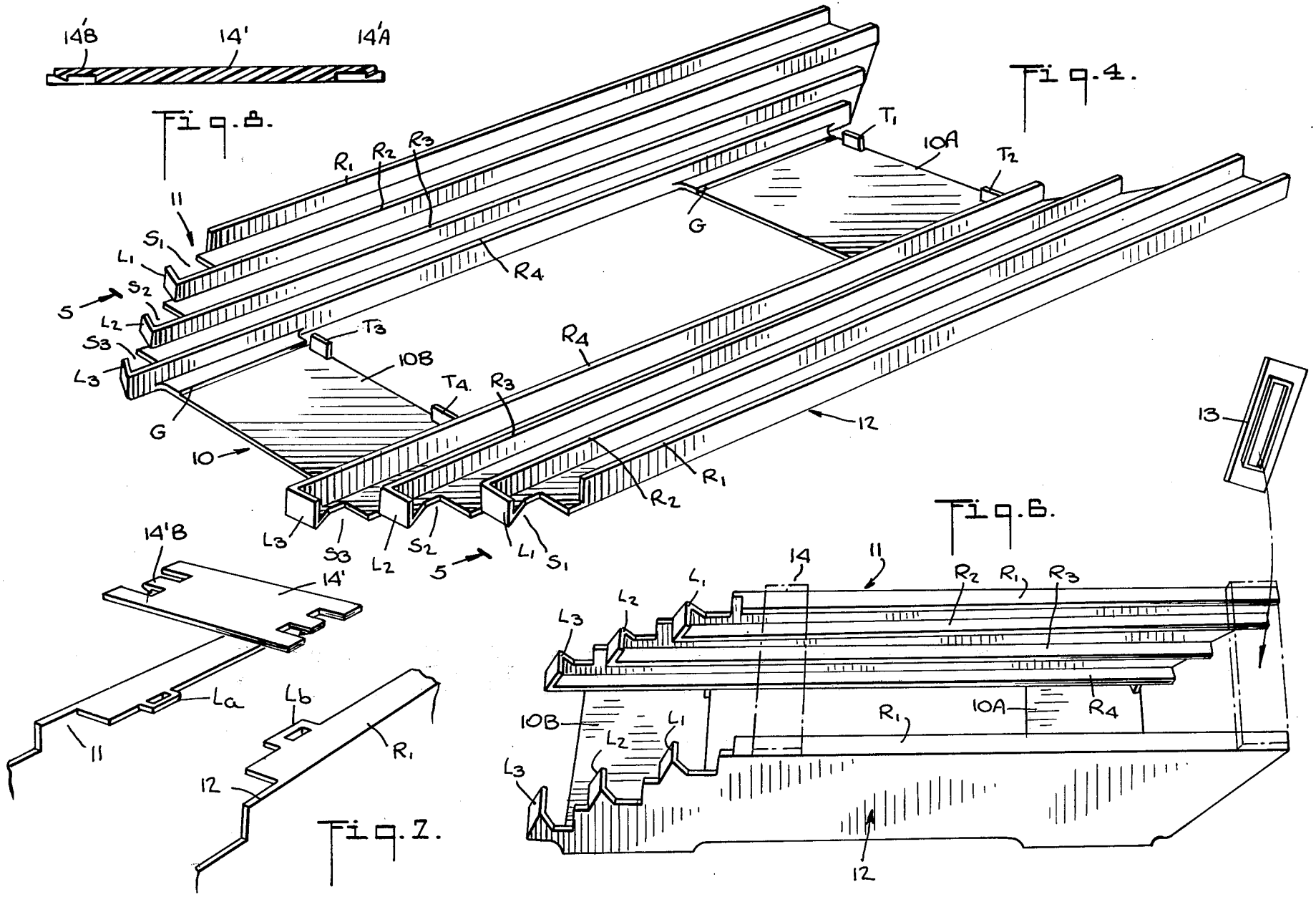
FIG. 4 is a perspective view of the injection-molded blank from which the unit shown in FIG. 1 is created.
FIG. 5 is a transverse section taken in the plane indicated by line 5—5 in FIG. 4.
FIG. 6 is a perspective view of the blank after it has been thermally folded.
FIG. 7 shows in perspective an alternative embodiment of a front slat arrangement for completing the unit.
FIG. 8 is a sectional view of the slat.

Referring first to FIG. 4, there is shown a unitary blank in accordance with the invention which is injection-molded of thermoplastic material, preferably polystyrene, an easily molded synthetic resin that is transparent and has high strength and impact resistance. The blank is constituted by a back wall 10 having an upper part 10A and a like lower part 10B to provide a space therebetween, whereby the back parts may be socketed in a turret or other display device for holding the unit in a vertical position.

Integral with back wall 10 is a pair of symmetrically-arranged side wall sections 11 and 12 each having a generally trapezoidal shape. Formed on each side wall section at corresponding positions thereon is a series of longitudinally-extending ridges $R_1$, $R_2$, $R_3$ and $R_4$. The outermost ridge $R_1$ on each side wall section runs along the outer edge of the section and the innermost ridge $R_4$ runs along the junction of the section and the back wall 10.

The lower ends of the side wall sections 11 and 12 have a progressively stepped formation to define descending steps $S_1$, $S_2$ and $S_3$. The ridges which terminate in these steps, are joined to lateral ledges $L_1$, $L_2$ and $L_3$. The parts 10A and 10B of the back wall are provided with grooves G which run adjacent the innermost ridges $R_4$ on the side wall sections 11 and 12 to facilitate folding. The upper edge of the upper back wall part 10A is provided with a pair of tabs $T_1$ and $T_2$ to maintain a spacing between the back wall and the side walls and the upper edge of the lower back wall section 10B is similarly provided with tabs $T_3$ and $T_4$.

After the blank is injection-molded, it is placed in a suitable jig and the back wall is heated in the region of grooves G until this region is sufficiently softened to permit the side walls 11 and 12 to be folded in along the groove lines to assume the configuration shown in FIG. 6 in which side walls 11 and 12 are parallel to each other and at right angles to back wall 10. Ridges $R_1$ to $R_4$ then project inwardly to define three parallel channels for receiving boxes.

The resulting chute-like dispenser unit is completed by upper and lower slats 13 and 14 secured to ridges $R_1$ on the side wall sections 11 and 12 to bridge these sections. These slats may be attached by means of a suitable adhesive. Because of the stepped formation of the side walls, a discharge opening is created at the lower end of each channel.

The Dispenser Unit

As shown in FIGS. 1 to 5, when the blank is thermally folded to form the frame and the slats 13 and 14 are attached thereto to complete the structure, the dispenser unit thus formed has three parallel channels each adapted to receive a vertical stack of small boxes B to be stored therein. Since the unit is fabricated of transparent plastic material, boxes B are visible, and the unit acts as a display therefor.

Because of the progressive steps $S_1$, $S_2$ and $S_3$, the lower end of each channel is open and constitutes a discharge outlet through which one is able to remove one box at a time. Each time a box is removed, the boxes thereabove in the stack drop down to make available a fresh box at the discharge opening.

FIGS. 7 and 8 illustrate an alternative means for providing snap-in slats to complete the unit without the need to adhere the slats in the manner disclosed previously. To this end, each slat (only a slat 14' is disclosed) takes the form of a rectangular strip of the same material as that from which the unit is fabricated, whose indented ends are provided with flexible tabs 14'A and 14'B, each having a tooth adapted to latch onto a loop ($L_a$ and $L_b$) extending from the edge of rib $R_1$ in each side wall. Thus it is merely necessary to press the slats onto the ribs to cause the tabs to snap in place, thereby simplifying the completion of the unit.

While there has been shown and described a preferred embodiment of a multi-channel box-dispenser unit in accordance with the invention, it will be appreciated that many changes and modifications may be made therein without, however, departing from the essential spirit thereof.

I claim:

1. A box dispenser unit including a blank formed of thermoplastic material created from an injection-molded flat blank in a one-piece operation, the blank thereafter being thermally foldable to assume the desired configuration, said unit comprising:

A a flat blank constituted by a back wall section and a pair of opposing side wall sections integral with the back wall section, said back wall section being formed by upper and lower rectangular parts having an opening therebetween, the back wall parts having grooves adjacent their junctions with the side wall sections to facilitate thermal folding, each side wall section having a series of longitudinally-extended ridges all of the same height formed thereon at corresponding-spaced positions, the outermost ridge running along the edge of the side wall section and the innermost ridge running along the junction of the side wall section having a progressively-stepped formation, the ridges at these steps terminating in holding ledges, whereby when the side wall sections are thermally folded in to assume parallel positions at right angles to the back wall section, the ridges then define a plurality of parallel channels each adapted to receive a stack of said boxes which are removable from discharge openings formed by said steps; and B slats bridging the outermost ridges of the parallel side wall sections.

2. A unit as set forth in claim 1, wherein said slats are provided with end tabs having teeth to catch onto loops formed at the edges of said outermost ridges.

3. A unit as set forth in claim 1, wherein said parts are provided with tabs serving as spacers between said parts and innermost ribs when the blank is thermally folded.

* * * * *